US010898740B2

(12) United States Patent
McKay

(10) Patent No.: US 10,898,740 B2
(45) Date of Patent: Jan. 26, 2021

(54) LINEMAN HARNESS AND HARNESS ADAPTER SYSTEMS

(71) Applicant: Nelson O. McKay, Santa Ana, CA (US)

(72) Inventor: Nelson O. McKay, Santa Ana, CA (US)

( * ) Notice: Subject to any disclaimer, the term of this patent is extended or adjusted under 35 U.S.C. 154(b) by 248 days.

(21) Appl. No.: 16/245,126

(22) Filed: Jan. 10, 2019

(65) Prior Publication Data

US 2019/0143155 A1 May 16, 2019

Related U.S. Application Data

(63) Continuation-in-part of application No. 15/247,071, filed on Aug. 25, 2016, now Pat. No. 10,213,631.

(51) Int. Cl.
*A62B 35/00* (2006.01)

(52) U.S. Cl.
CPC ..... *A62B 35/0037* (2013.01); *A62B 35/0018* (2013.01); *A62B 35/0075* (2013.01)

(58) Field of Classification Search
CPC ..... A62B 35/0037; A62B 35/0018; A62B 35/0075
See application file for complete search history.

(56) References Cited

U.S. PATENT DOCUMENTS

| | | | | |
|---|---|---|---|---|
| 3,701,395 | A | 10/1972 | Theobald | |
| 5,785,146 | A * | 7/1998 | Palmer | A62B 35/0068 182/3 |
| 9,308,402 | B2 | 4/2016 | Chevalier | |
| 2008/0011545 | A1 | 1/2008 | Turner | |
| 2009/0255756 | A1 | 10/2009 | Green | |
| 2012/0012421 | A1 | 1/2012 | Morgan | |
| 2013/0062144 | A1 | 3/2013 | Fleming | |
| 2015/0202475 | A1 * | 7/2015 | Botti | A62B 35/0037 182/3 |
| 2016/0176683 | A1 | 6/2016 | Huehn | |

OTHER PUBLICATIONS

Ver Sales Inc., catalog 106, p. 115; Burbank, CA.., USA.

* cited by examiner

*Primary Examiner* — Alvin C Chin-Shue
(74) *Attorney, Agent, or Firm* — CIONCA IP Law P.C.; Marin Cionca

(57) ABSTRACT

An integral lineman safety harness system, having: a body harness having: a belt; a back ring; a left belt strap; and a right belt strap; and a harness adapter having: a first strap having a first top end; wherein a first harness loop at a first bottom end and the left belt strap are sewn around a first ring element; a second strap having a second top end; wherein a second harness loop at a second bottom end and the right belt strap are sewn around a second ring element; a third strap having a third top end; wherein a back loop at a third bottom end is sewn around the back ring; wherein the first strap, the second strap, and the third strap join at the first top end, the second top end, and the third top end into a single top loop configured to receive a locking element.

12 Claims, 13 Drawing Sheets

LINEMAN HARNESS AND HARNESS ADAPTER SYSTEMS

CROSS-REFERENCE TO RELATED APPLICATIONS

This application is a continuation-in-part of and claims the benefit of U.S. Non-Provisional application Ser. No. 15/247,071, filed Aug. 25, 2016, which is hereby incorporated by reference, to the extent that it is not conflicting with the present application.

BACKGROUND OF INVENTION

1. Field of the Invention

The invention relates generally to safety equipment and more specifically to harnesses for preventing falls and/or for securing to a safety line.

2. Description of the Related Art

Linemen working to repair telephone lines, perform rescue operations, and other similar functions may be transported and supported by helicopter, and may wear harnesses for fall protection and as a method of being carried and transported during such repair or rescue work. Harnesses known in the art can be unsafe since some inhibit blood flow in the legs. Front-attached harnesses, with a safety cable attaching to the lineman's chest, for example, can run in front of their body and restrict the vision and/or movement of the lineman, who then may have to lean to the side to perform their work. Back-attached harnesses may use leg loops, which, when supported only by a single point on the user's back, may tighten and restrict blood flow in the legs. Therefore, a solution is needed to safely support a lineman from the back.

When connecting two or more linemen together, the connecting safety rope between individuals may be in the front of the lower person. Therefore, this individual's vision may be restricted, and a solution is needed to safely support two more linemen together by connecting them via back-attached harnesses. The weight of the lower lineman may also put a strain on the upper lineman, and may also cause blood flow problems.

Therefore, there is a need for a solution to these problems.

The aspects or the problems and the associated solutions presented in this section could be or could have been pursued; they are not necessarily approaches that have been previously conceived or pursued. Therefore, unless otherwise indicated, it should not be assumed that any of the approaches presented in this section qualify as prior art merely by virtue of their presence in this section of the application.

BRIEF INVENTION SUMMARY

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

In an aspect an adapter for a full body harness is provided, for vertical use during rescue, repair, or other work performed by a lineman, wherein the adapter straps are placed on the user's back and has three points of attachment to the full body harness. Thus, an advantage is the weight of the user is more evenly distributed throughout the full body harness. Another advantage is that there is no visual obstruction or restriction of movement for the user, with the adapter and safety line being placed behind the user.

In another aspect, an adapter for a full body harness is provided, having an additional loop at the end of the adapter straps, for connecting a first user to a second user. Thus, an advantage is that a plurality of users may be safely connected without visual obstruction, without movement restriction, and with even weight distribution throughout their full body harnesses.

In another aspect, an integral harness system is provided for vertical use during rescue, repair, or other work performed by a lineman, wherein the points of attachment for bearing the weight of the user and any other additional weights, loads, or users are located at straps that are placed on the user's back and attached to the left and right sides of the belt of a harness and at the upper back of the harness at the back ring of the harness, such that there are three points of attachment between the harness adapter and the full body harness. The integral harness system may be provided with locking elements in the loops at the ends of the straps that are sewn into the straps and into the belt of the harness, and the back ring of the harness, such that accidental removal or loosening of the elements of the harness system are minimized and eliminated. Thus, an advantage may be that safety may be increased for the user due to the decreased risk in releasing any of the safety elements from one another, and due to the proper connections between elements being provided, such that the user does not need to make the connections themselves, and the risk of making mistakes while putting the system together or connecting the elements of the harness adapter system may be reduced or eliminated. Another advantage may be the safety of the user may be increased by ensuring that the integral harness system is worn by the user as intended and incorrect or improper wearing of the harness may be reduced or eliminated. Another advantage may be that strain on the user's legs is relieved, reduced, or eliminated by a more even or proper distribution of weight held throughout the harness system, and blood flow of the user is not restricted by unnecessary strain or squeezing on the user by the harness system. Another advantage is that there is no visual obstruction or restriction of movement for the user, with the adapter and safety line being placed behind the user.

In another aspect, an integral lineman safety harness system is provided, comprising: a first harness adapter; and a first body harness having: a belt; a back ring on a rear side of the first body harness; a left belt strap sewn onto a left side of the belt; and a right belt strap sewn onto a right side of the belt; the first harness adapter having: a first strap having a first top end, a first bottom end, a first harness loop at the first bottom end, and a first ring element; wherein the first harness loop and the left belt strap are sewn around the first ring element; a second strap having a second top end, a second bottom end, a second harness loop at the second bottom end, and a second ring element; wherein the second harness loop and the right belt strap are sewn around the second ring element; a third strap having a third top end, a third bottom end, and a back loop at the third bottom end; wherein the back loop is sewn around the back ring; wherein the first strap, the second strap, and the third strap join at the first top end, the second top end, and the third top end into a single first top loop configured to receive a first locking element; wherein the first strap extends through the back ring such that the first harness loop is sewn around the left belt strap; and wherein the second strap extends through the back ring such that the second harness loop is sewn around the right belt strap. Thus, again, an advantage may be that safety may be increased for the user due to the decreased risk in releasing any of the safety elements from one another, and due to the proper connections between elements being provided, such that the user does not need to make the connections themselves, and the risk of making mistakes while putting the system together or connecting the elements of the harness adapter system may be reduced or eliminated. Another advantage may be the safety of the user may be increased by ensuring that the integral harness system is worn by the user as intended and incorrect or improper wearing of the harness may be reduced or eliminated. Another advantage may be that strain on the user's legs is relieved, reduced, or eliminated by a more even or proper distribution of weight held throughout the harness system, and blood flow of the user is not restricted by unnecessary strain or squeezing on the user by the harness system. Another advantage is that there is no visual obstruction or restriction of movement for the user, with the adapter and safety line being placed behind the user.

In another aspect, an integral lineman safety harness system is provided, comprising: a first harness adapter; and a first body harness having: a belt; a back ring on a rear side of the first body harness; a left belt strap sewn onto a left side of the belt; and a right belt strap sewn onto a right side of the belt; a harness adapter connector; the first harness adapter having: a first strap having a first top end, a first bottom end, a first harness loop at the first bottom end, a first ring element, and a first extension loop at the first bottom end; wherein the first harness loop and the left belt strap are sewn around the first ring element; a second strap having a second top end, a second bottom end, a second harness loop at the second bottom end, a second ring element, and a second extension loop at the second bottom end; wherein the second harness loop and the right belt strap are sewn around the second ring element; and a third strap having a third top end, a third bottom end, and a back loop at the third bottom end; wherein the back loop is sewn around the back ring; wherein the first strap, the second strap, and the third strap join at the first top end, the second top end, and the third top end into a single first top loop configured to receive a first locking element; the harness adapter connector comprising: a first connector strap having: a first top connector end, a first bottom connector end, a first top connector loop at the first top connector end, and a first bottom connector loop at the first bottom connector end; and a second connector strap having: a second top connector end, a second bottom connector end, a second top connector loop at the second top connector end, and a second bottom connector loop at the second bottom connector end; wherein the first strap and the second strap each have a first length, and the third strap has a second length shorter than the first length; wherein the first strap extends through the back ring such that the first harness loop is sewn around the left belt strap; wherein the second strap extends through the back ring such that the second harness loop is sewn around the right belt strap; wherein the first extension loop is joined to the first top connector loop by a second locking element; and wherein the second extension loop is joined to the second top connector loop by a third locking element. Thus, again, an advantage may be that safety may be increased for the user due to the decreased risk in releasing any of the safety elements from one another, and due to the proper connections between elements being provided, such that the user does not need to make the connections themselves, and the risk of making mistakes while putting the system together or connecting the elements of the harness adapter system may be reduced or eliminated. Another advantage may be the safety of the user may be increased by ensuring that the integral harness system is worn by the user as intended and incorrect or improper wearing of the harness may be reduced or eliminated. Another advantage may be that strain on the user's legs is relieved, reduced, or eliminated by a more even or proper distribution of weight held throughout the harness system, and blood flow of the user is not restricted by unnecessary strain or squeezing on the user by the harness system. Another advantage is that there is no visual obstruction or restriction of movement for the user, with the adapter and safety line being placed behind the user.

The above aspects or examples and advantages, as well as other aspects or examples and advantages, will become apparent from the ensuing description and accompanying drawings.

BRIEF DESCRIPTION OF THE DRAWINGS

For exemplification purposes, and not for limitation purposes, aspects, embodiments or examples of the invention are illustrated in the figures of the accompanying drawings, in which.

DETAILED DESCRIPTION

Figure 1:
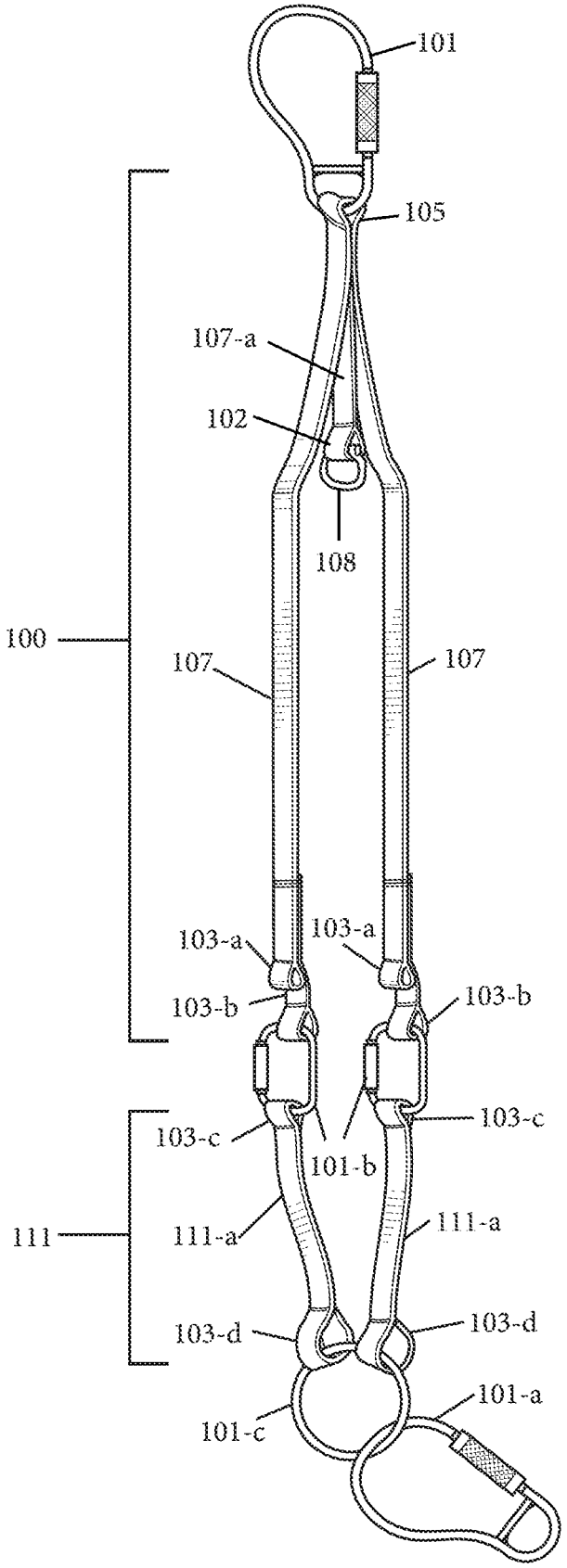
FIG. 1 illustrates the front perspective view of a three-point lineman harness adapter which may be used within a harness adapter system, according to an aspect.

What follows is a description of various aspects, embodiments and/or examples in which the invention may be practiced. Reference will be made to the attached drawings, and the information included in the drawings is part of this detailed description. The aspects, embodiments and/or examples described herein are presented for exemplification purposes, and not for limitation purposes. It should be understood that structural and/or logical modifications could be made by someone of ordinary skills in the art without departing from the scope of the invention. Therefore, the scope of the invention is defined by the accompanying claims and their equivalents.

It should be understood that, for clarity of the drawings and of the specification, some or all details about some structural components or steps that are known in the art are not shown or described if they are not necessary for the invention to be understood by one of ordinary skills in the art.

For the following description, it can be assumed that most correspondingly labeled elements across the figures (e.g., 104 and 204, etc.) possess the same characteristics and are subject to the same structure and function. If there is a difference between correspondingly labeled elements that is not pointed out, and this difference results in a non-corresponding structure or function of an element for a particular embodiment, example or aspect, then the conflicting description given for that particular embodiment, example or aspect shall govern.

FIG. 1 illustrates the front perspective view of a three-point lineman harness adapter 100 ("three-point harness adapter," "lineman harness adapter," or "harness adapter") which may be used within a harness adapter system, according to an aspect. As an example, the harness adapter 100 of the system may be provided separately from other elements of the harness adapter system, and may be used in conjunction with, for example, a full body harness ("full body harness," "body harness," or "harness"), as shown by 204 in FIG. 2, or any combination of a chest harness and/or seat harness, and may also be used in association with additional harness adapters by using a harness adapter connector 111. As another example, an integral harness adapter system may also be provided, wherein various elements of the harness system are integrated together, as will be discussed further herein when referring to FIGS. 2B, 3B, 4B, 5B, 6B, and 7B.

The harness adapter 100 may be securely connected to another element, such as, for example, a helicopter, another user, or a safety line, by a carabiner 101 or any other suitable locking element that hooks into a top loop 105 of the harness adapter 100. The helicopter, other user, or any other secure element that the carabiner 101 or other locking element may be suspended above the user that is wearing the lineman harness adapter 100 and associated harness. The harness adapter 100 may have two straps 107, each of which may include a first bottom loop ("bottom loop" or "bottom end loop") 103-*a* and a second bottom loop 103-*b* at their ends as shown ("end loop pair"), or may include only one bottom loop 103-*a* at each end (as shown in FIG. 2). An end loop pair may include one harness loop 103-*a* and one extension loop 103-*b*. The harness loops 103-*a* may be used to connect the harness adapter 100 to a body harness, and the extension loops 103-*b* may be used to connect a user wearing the harness adapter system to another user wearing a harness adapter system.

The harness adapter 100 may also include a third strap 107-*a*, which may be shorter than the first and second straps 107. The first and second straps 107 and third strap 107-*a* may converge at their top ends to form a top loop 105. A harness adapter 100 having one or two bottom loops may be used according to the user's needs. The three points of attachment to a harness worn by a user may be using the back loop 102, which may have a locking element such as a D-ring 108 or any other suitable locking element to lock the back loop into the full body harness 304 (as shown in FIG. 3A), and bottom loops 103-*a* and/or 103-*b*, which may lock into a belt portion of the full body harness (as shown by 210 in FIG. 2A).

As an example, a harness adapter 100 having only one bottom loop 103-*a* may be used if only one user is to be connected to a safety line, while a harness adapter 100 having two bottom loops 103-*a* and 103-*b* may be used if a first user will be connected to a safety line, and a second user will also be connected to the first user. If, for example, a second user is to be connected to the first user, a harness adapter connector 111 may be used, which may comprise two straps 111-*a* each having a top connector end loop 103-*c* and a bottom connector end loop 103-*d*. An O-ring 101-*c* and a second carabiner 101-*a* or any other suitable locking element may be used to secure the second user's harness adapter to the first harness adapter 100 via the harness adapter connector 111, as shown in FIG. 1. The O-ring 101-*c* may be secured in the bottom connector end loops 103-*d* of the harness adapter connector 111. The O-ring 101-*c* may then connect to a second carabiner 101-*a*, or may directly connect with a second user's harness adapter (as shown in FIG. 7).

Figure 2A:
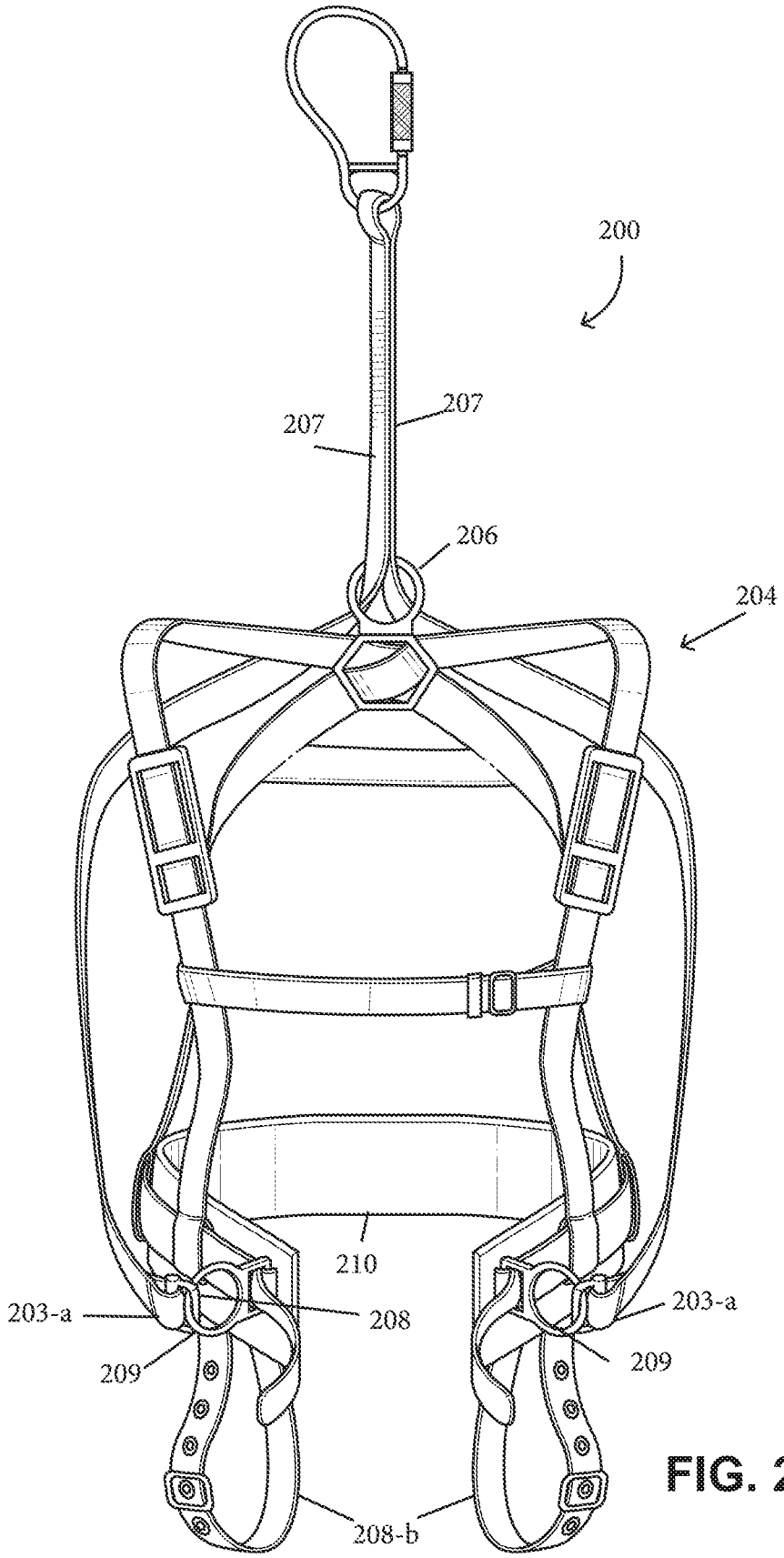
FIG. 2A illustrates the front view of the harness adapter used in association with a full body harness, according to an aspect.
Figure 3A:
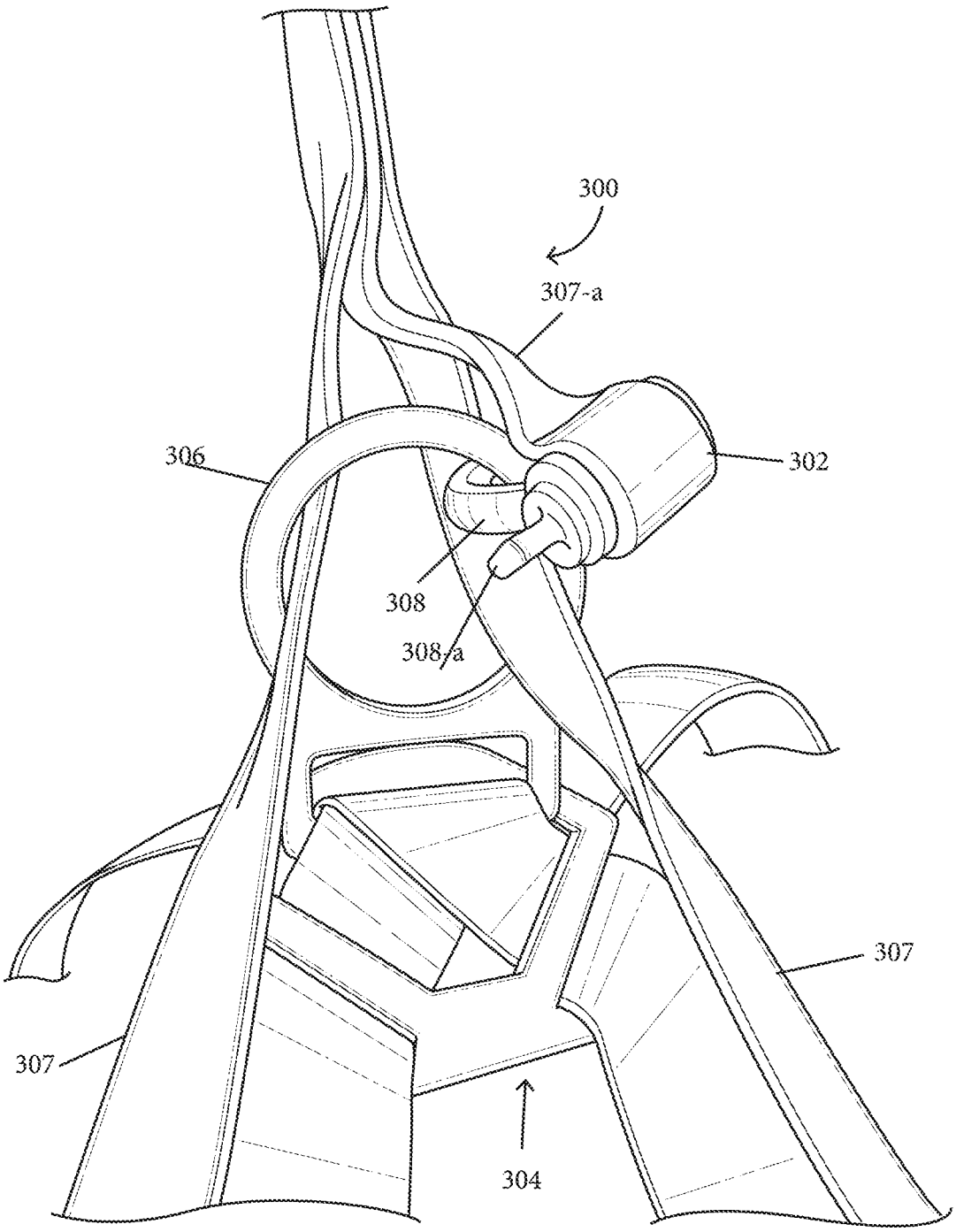
FIG. 3A illustrates a detailed enlargement of the partial back view of the back loop of the harness adapter connecting to the back ring of the full body harness, according to an aspect.

FIG. 2A illustrates the front view of the harness adapter 200 used in association with a full body harness 204, according to an aspect. The harness adapter 200 may be used with a full body harness, with a prior art example of a full body harness being shown by 204. The harness adapter 200 may connect with the full body harness 204 at three attachment points. First, the two straps 207 may pass through a back ring 206 of the full body harness 204, to which the top loop is secured. The back loop (shown as 102 in FIG. 1, and not visible in FIG. 2A) may connect to the back ring 206 (as shown in enlarged detail in FIG. 3A). Second, one strap 207 may connect to the full body harness 204 on the left side of the user. Third, the other strap 207 may connect to the full body harness 204 on the right side of the user, similar to the connection on the left side. Belt rings 209 may be attached to a full body harness 204 or a seat harness on a belt portion ("belt" or "belt portion") 210, and may be used for making the second and third connections to the harness adapter 200. The three points of attachment may help to relieve pressure from the leg loops 208-*b* by more evenly distributing the weight of the user held by the harness 204 and harness adapter 200.

Figure 2B:
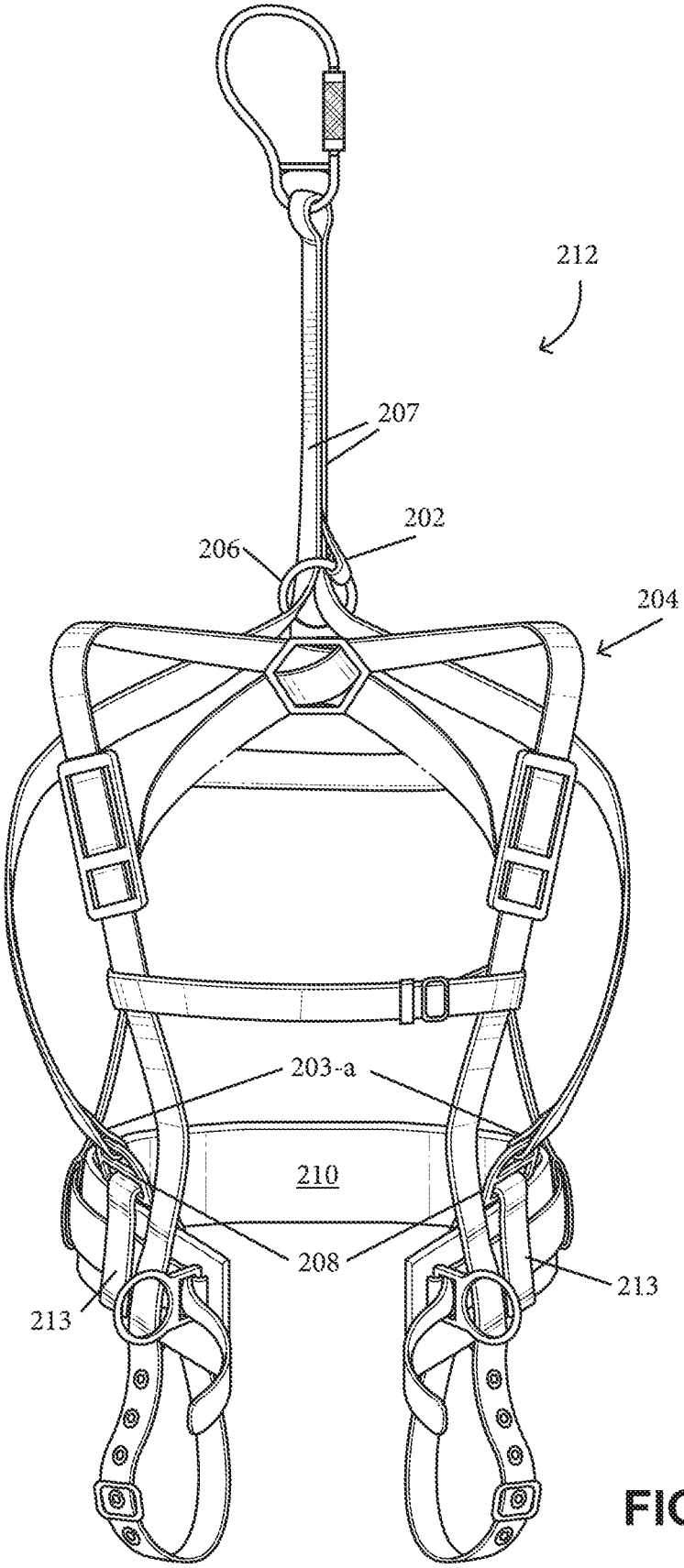
FIG. 2B illustrates the front view of an integral harness adapter system, according to an aspect.

FIG. 2B illustrates the front view of an integral harness adapter system ("integral harness adapter system," "integral harness system," or "integral system") 212, according to an aspect. The integral harness adapter system 212 may be used as a lineman safety harness system, and may be similar to the harness adapter system illustrated as an example in FIG. 2A, and may be provided with elements integrated with each other. An advantage may be that safety may be increased for the user due to the decreased risk in releasing any of the safety elements or any portions of the integral harness adapter system from one another, and due to the proper connections between elements being provided for the user, such that the user does not need to make the connections themselves. Thus, the risk of making mistakes while putting the system together or connecting the elements of the harness adapter system may be reduced or eliminate, and incorrect or improper wearing of the harness may be reduced or eliminated.

The integral harness adapter system 212 may be provided with a harness 204 having a belt 210, a first and second strap 207, a third strap (not visible, located in between the first and second strap, and shown by 107-*a* in FIG. 1). The first and second straps 207 may each be provided with a bottom loop 203-*a*. Each bottom loop 203-*a* may have a locking element such as a D-ring 208 sewn into the bottom loop 203-*a*, due to the bottom loop 203-*a* being sewn around the D-ring 208 or other locking element. The D-ring 208 may also be sewn into the belt 210 via a belt strap 213, wherein the belt strap 213 is sewn around the D-ring 208 or other locking element. The belt strap 213 may be sewn onto the belt 210, and thus may be provided as an element that is not removable from the harness system 212. Thus, the locking elements 208 on the left and the right sides of the integral harness system 212 may be provided such that they cannot be removed from the bottom loops 203-*a* or the belt straps 213. Similarly, the third strap may have a back loop 202, and the back ring 206 of the harness 204 may be sewn into the back loop 202. Thus, the back ring 206 may be provided such that it may not be removed from the third strap's back loop 202. It should be understood that the locking elements having strap loops sewn around them may be provided as ring elements which do not open and close. It should also be understood that the locking or ring elements may be provided in any suitable shape and size having an open center portion through which a strap loop can be threaded and subsequently sewn. It should also be understood that each sewn loop may have a permanent ring element received and sewn within it, or may also receive a removable locking element. It should also be understood that the locking elements referred to when discussing FIGS. 2B, 3B, 4B, 5B, 6B, and 7B may be provided as ring elements which may be permanent and may not be removable from the system without removal or cutting of the loops themselves. An advantage may be that the various elements of the integral harness system 212 cannot become loose and/or fall off, and it also may not be possible for the user to accidentally loosen or remove the elements of the system or make incorrect connections of the elements. Thus, the safety of the user may be increased by ensuring that the integral harness system 212 is worn by the user as intended. It should be understood that any suitable heavy-duty sewing, seaming, or joining methods may be used as known in the art to securely create the loops and hold the integral harness system 212 together.

FIG. 3A illustrates a detailed enlargement of the partial back view of the back loop 302 of the harness adapter 300 connecting to the back ring 306 of the full body harness 304, according to an aspect. The harness adapter 300 may include a first strap 307, a second strap 307 similar to the first strap, and a third strap 307-*a* shorter than the first and second straps 307. The third strap 307-*a* may include a back loop 302 at its bottom end. The first and second straps 307 may be inserted through the back ring 306, while the back loop 302 may be locked into the same back ring 306 by a D-ring 308 or any other suitable locking element. The D-ring or other type of locking element may be threaded into the back loop 302, and secured into place by, for example, a screw 308-*a*. The back ring 306 may be worn on the back of the user's torso when a harness is worn. As an example, the back ring 306 may be placed at or around the level of the user's shoulders, and may be placed between the shoulder blades of the user.

Figure 3B:
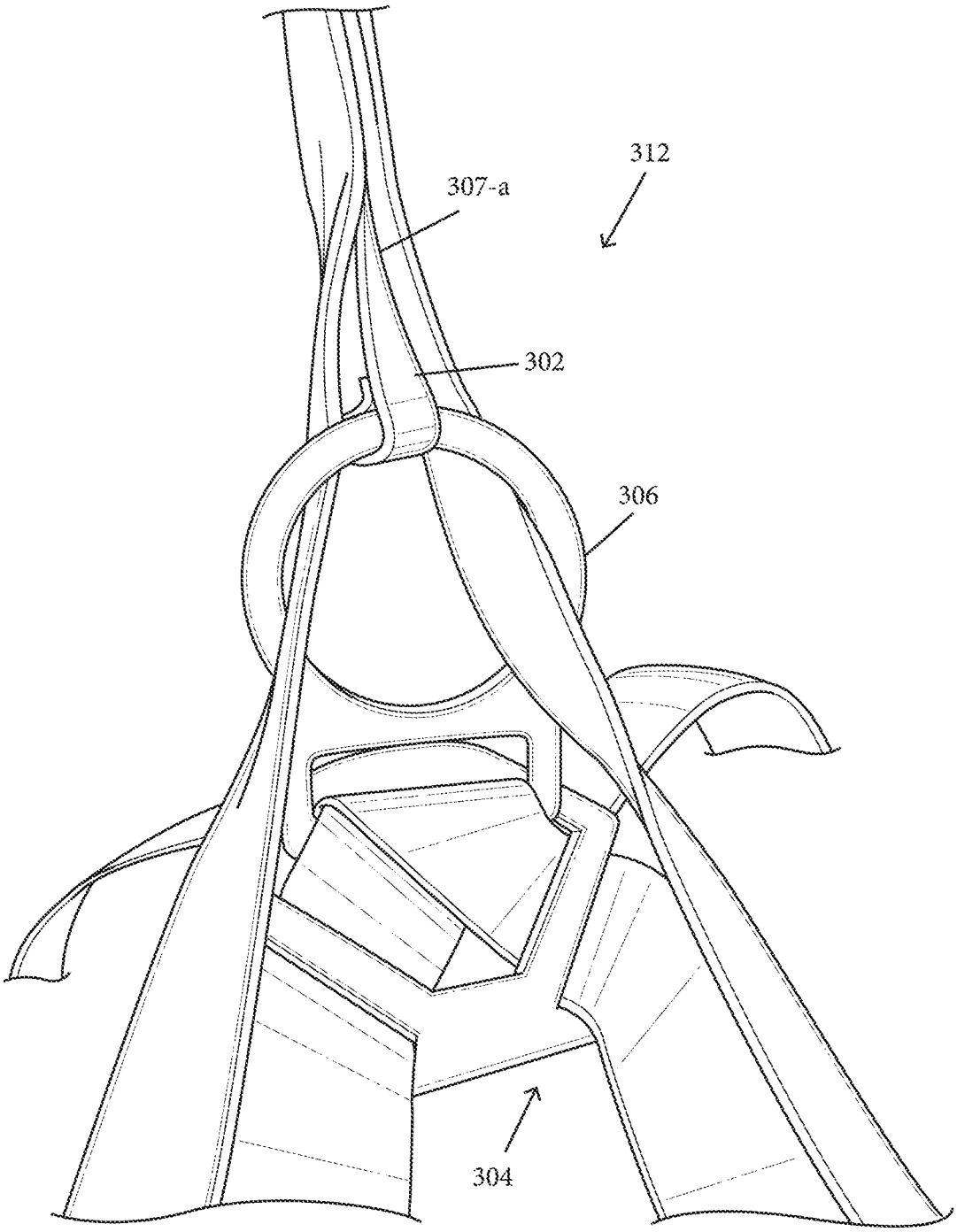
FIG. 3B illustrates a detailed enlargement of the partial back view of the back loop of the integral harness adapter system, with the back ring of the full body harness sewn into the back loop, according to an aspect.

FIG. 3B illustrates a detailed enlargement of the partial back view of the back loop 302 of the integral harness adapter system 312, with the back ring 306 of the full body harness 304 sewn into the back loop 302, according to an aspect. Again, the integral harness system 312 may be provided with a first and second strap 307. Both the first and second straps 307 may pass through the back ring 306. The back loop 302 may be provided at the end of the third strap 307-*a*, and the back ring 306 may pass through and be sewn into the back loop 302. Thus, the D-ring, as shown by 308 in FIG. 3A, may not be needed within the integral harness system 312. This may prevent the back ring 306 from becoming separated from the back loop 302.

Figure 4A:
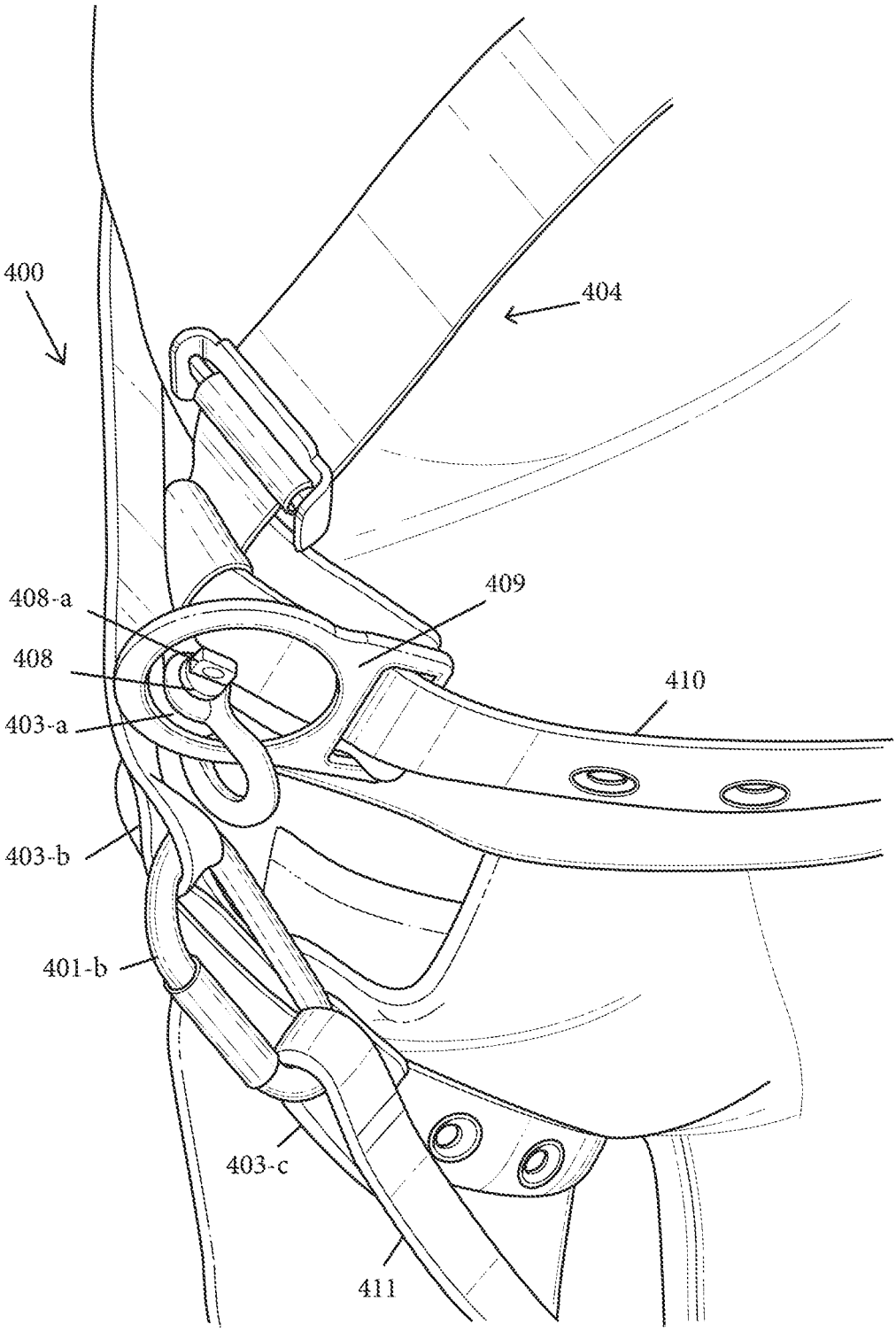
FIG. 4A illustrates a detailed enlargement of the partial front view of the harness adapter connected to a belt ring of the full body harness belt, according to an aspect.

FIG. 4A illustrates a detailed enlargement of the partial front view of the harness adapter 400 connected to a belt ring 409 of the full body harness belt 410, according to an aspect. Similar to the connection of the D-ring 308 in the back loop 302 to the back ring 306 (as shown in FIG. 3), one bottom loop 403-*a* may be connected to a belt ring 409, by a D-ring 408 or any other suitable locking element threaded into the bottom loop 403-*a* and secured by, for example, a screw 408-*a*. As an example, a front view of the user's right side is shown in FIG. 4. A similar connection may be made also on the user's left side. The two belt rings 409 may be located on a belt portion 410 of the full body harness 404, with one belt ring 409 located at the left side at the waist level of the user, and the second belt ring 409 located at the right side at the waist level of the user.

If, for example, a second user or a second load is to be connected to the first user, a carabiner 401-*b* may be inserted into the second bottom loop 403-*b* and the top connector end loop 403-*c* of the harness adapter connector 411.

Figure 4B:
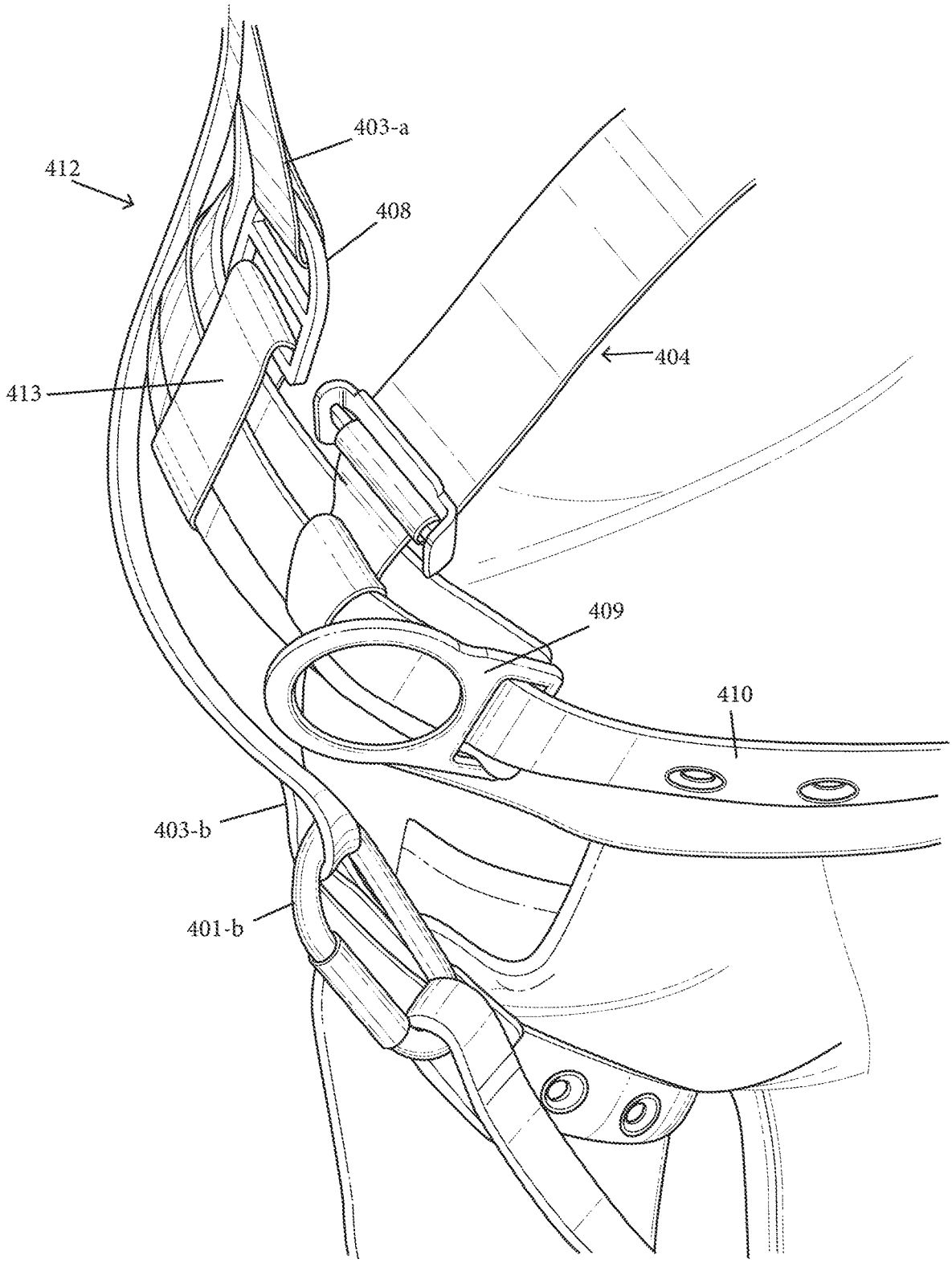
FIG. 4B illustrates a detailed enlargement of the partial front view of the integral harness system, according to an aspect.

FIG. 4B illustrates a detailed enlargement of the partial front view of the integral harness system 412, according to an aspect. As previously described when referring to FIG. 2B, each side of the integral harness system 412 may have a belt strap 413 on the belt 410. The bottom loop 403-*a* may be provided again as described when referring to FIG. 4A, and a locking element such as a D-ring 408 may again be provided and threaded into the bottom loop 403-*a*. Again as before when referring to FIGS. 2B and 3B, the D-ring 408 may be sewn into the bottom loop 403-*a*. Thus, similar to the connections described when referring to FIG. 3B, the belt ring 409 may not be needed to create a connection of the bottom loop 403-*a* to the belt 410. A similar connection may be made also on the user's left side.

Again as an example, if a second user or a second load is to be connected to the first user, a carabiner 401-*b* may be inserted into the second bottom loop 403-*b* and the top connector end loop 403-*c* of the harness adapter connector 411. An advantage may be that the user can optionally remove the means for carrying a second load or second user. As another example, the second connection may be a permanent or integral connection in the integral harness system 412, wherein the locking element 401-*b* between the bottom loop 403-*b* and the top connector end loop 403-*c* is again sewn in. Thus, the risk of creating incorrect, weak, or loose connections may be reduced, and safety of the users may be increased.

Figure 5A:
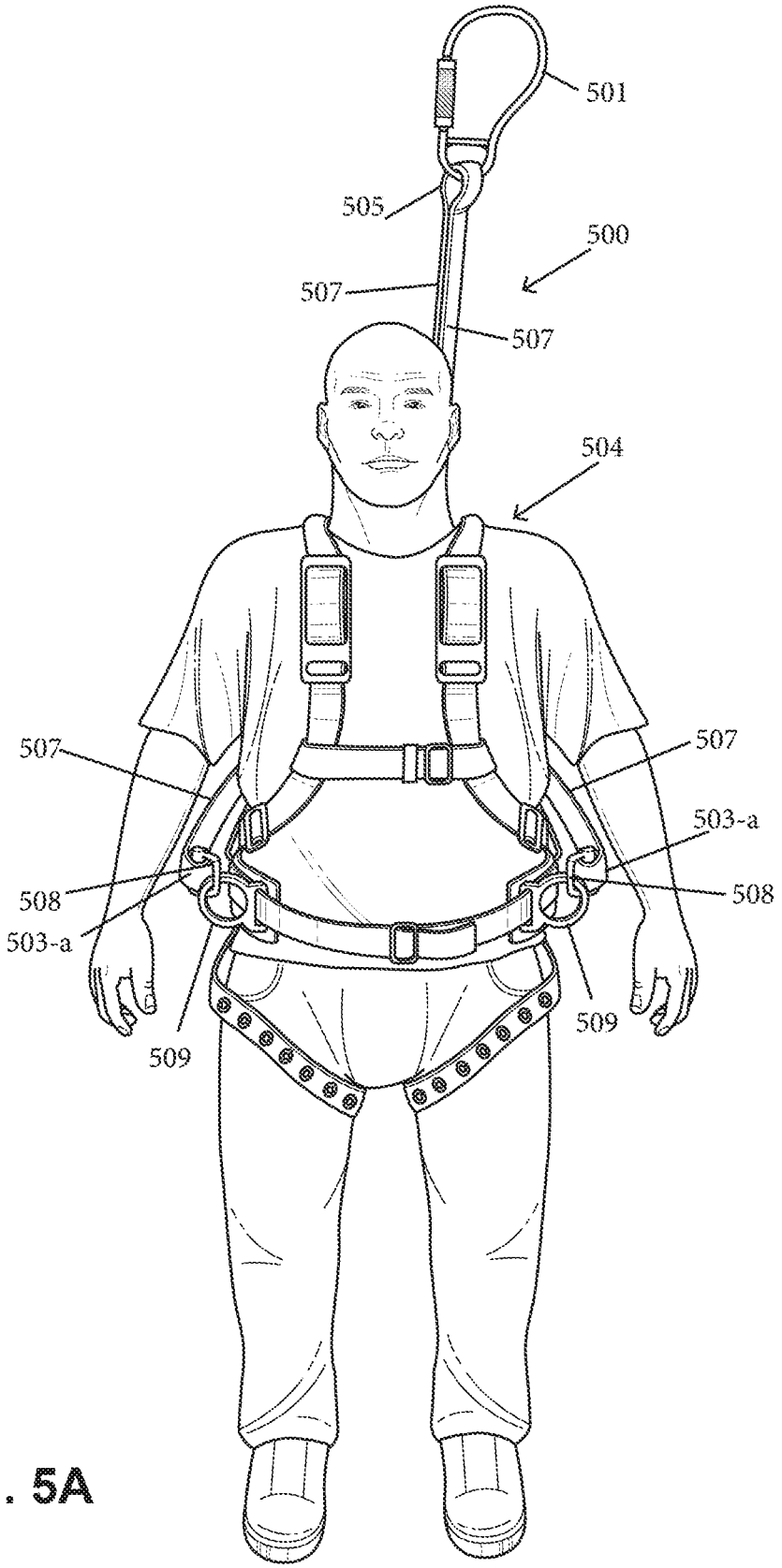
FIG. 5A illustrates the front view of the harness adapter connected with a full body harness, worn by a user, according to an aspect.

FIG. 5A illustrates the front view of the harness adapter 500 connected with a full body harness 504, worn by a user, according to an aspect. The straps 507 of the harness adapter 500 may be positioned behind the user, such that the harness adapter 500 connecting the user to, for example, a helicopter, by a carabiner 501 threaded into top loop 505, does not need to be attached in front of the user. The straps 507 may then come to the sides of the user, and connect to the harness 504, via the bottom loop 503-*a* attached to a locking element 508, which is then locked into the belt rings 509. Two points of attachment may thus be at the sides of the waist of the user, as shown by belt rings 509.

Figure 5B:
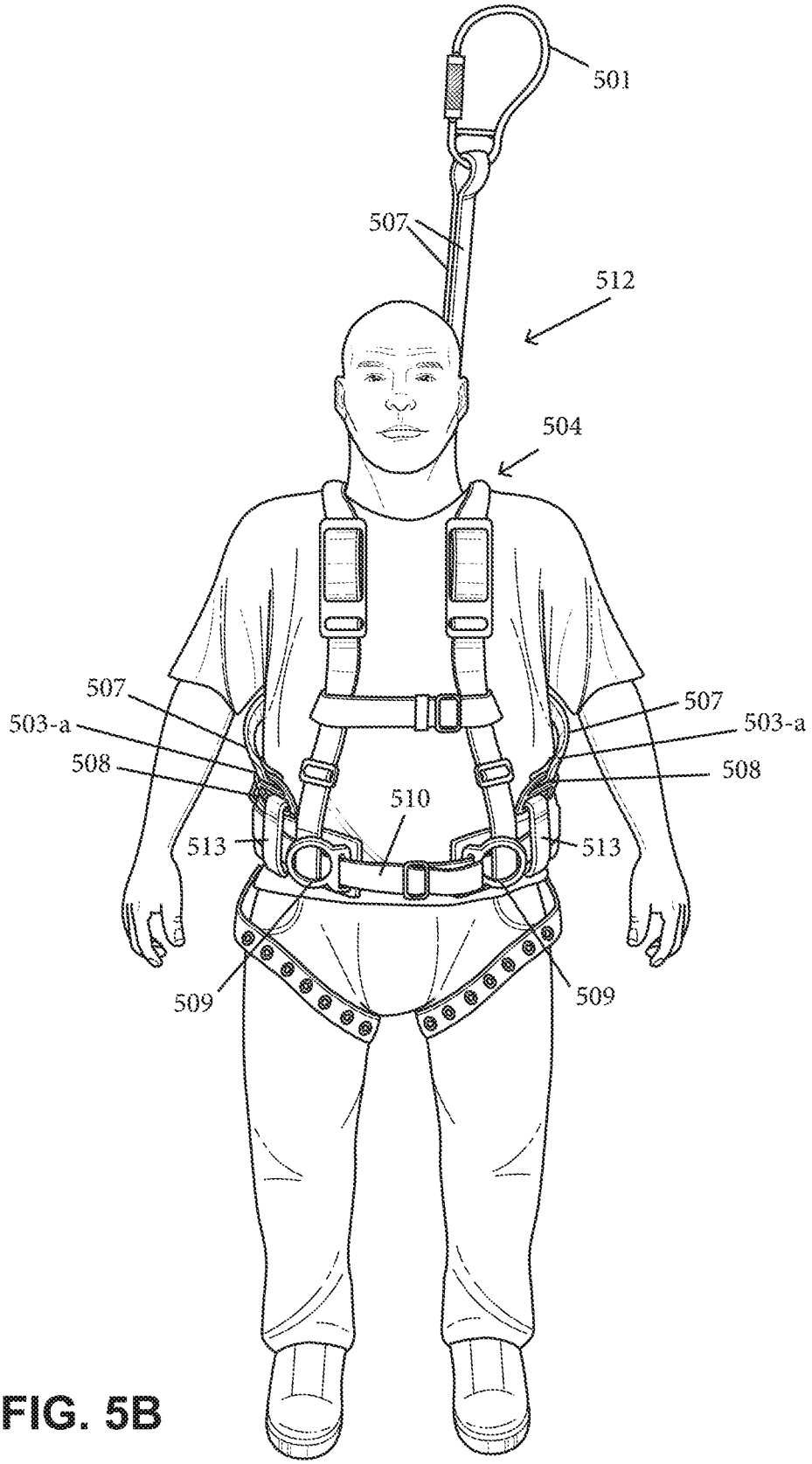
FIG. 5B illustrates the front view of the integral harness system worn by a user, according to an aspect.

FIG. 5B illustrates the front view of the integral harness system 512 worn by a user, according to an aspect. Again as in the harness adapter system shown and described when referring to FIG. 5A, the straps 507 of the integral harness system 512 may be positioned behind the user, such that the integral harness system 512 connecting the user to, for example, a helicopter, by a carabiner 501 threaded into top loop 505, does not need to be attached in front of the user. The straps 507 may then come to the sides of the user, and connect to the full body harness 504. Two points of attachment may be at the sides of the waist of the user, as shown by belt straps 513. The belt rings 509 may be free of connections to the straps 507, and may be used for tightening or securing the belt 510, for example, or for carrying any other additional accessories or gear needed by the user, for example.

Figure 6A:
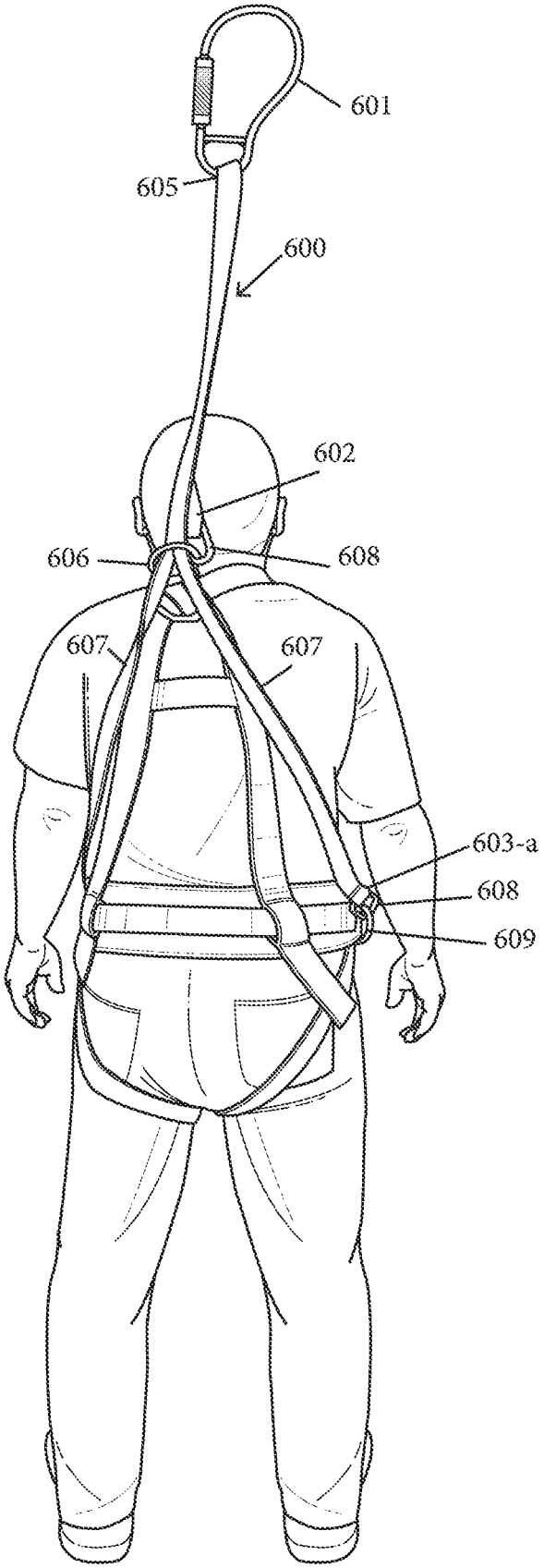
FIG. 6A illustrates the back view of the harness adapter connected with a full body harness, worn by a user, according to an aspect.

FIG. 6A illustrates the back view of the harness adapter 600 connected with a full body harness 604, worn by a user, according to an aspect. The straps 607 of the harness adapter 600 may both thread through a back ring 606. The back ring 606 may be located at the back of a user's torso, as shown. When a harness adapter 600 is connected to an object or person above the user, by a carabiner 601 or any other suitable locking element threading through top loop 605, the user may be held vertically without any straps or connections in front of them. A connection to a helicopter or to another user by an attachment point on, for example, the user's chest may obstruct the user's vision and/or accessibility to their work. Thus, an advantage of the harness adapter 600 having an attachment point on the user's back is that the user is free of obstructions. Again as previously described, a locking element 608 may be used for connecting the back loop 602 with the back ring 606. A locking element 608 may also be used for connecting the bottom loop 603-*a* with the belt ring 609.

Figure 6B:
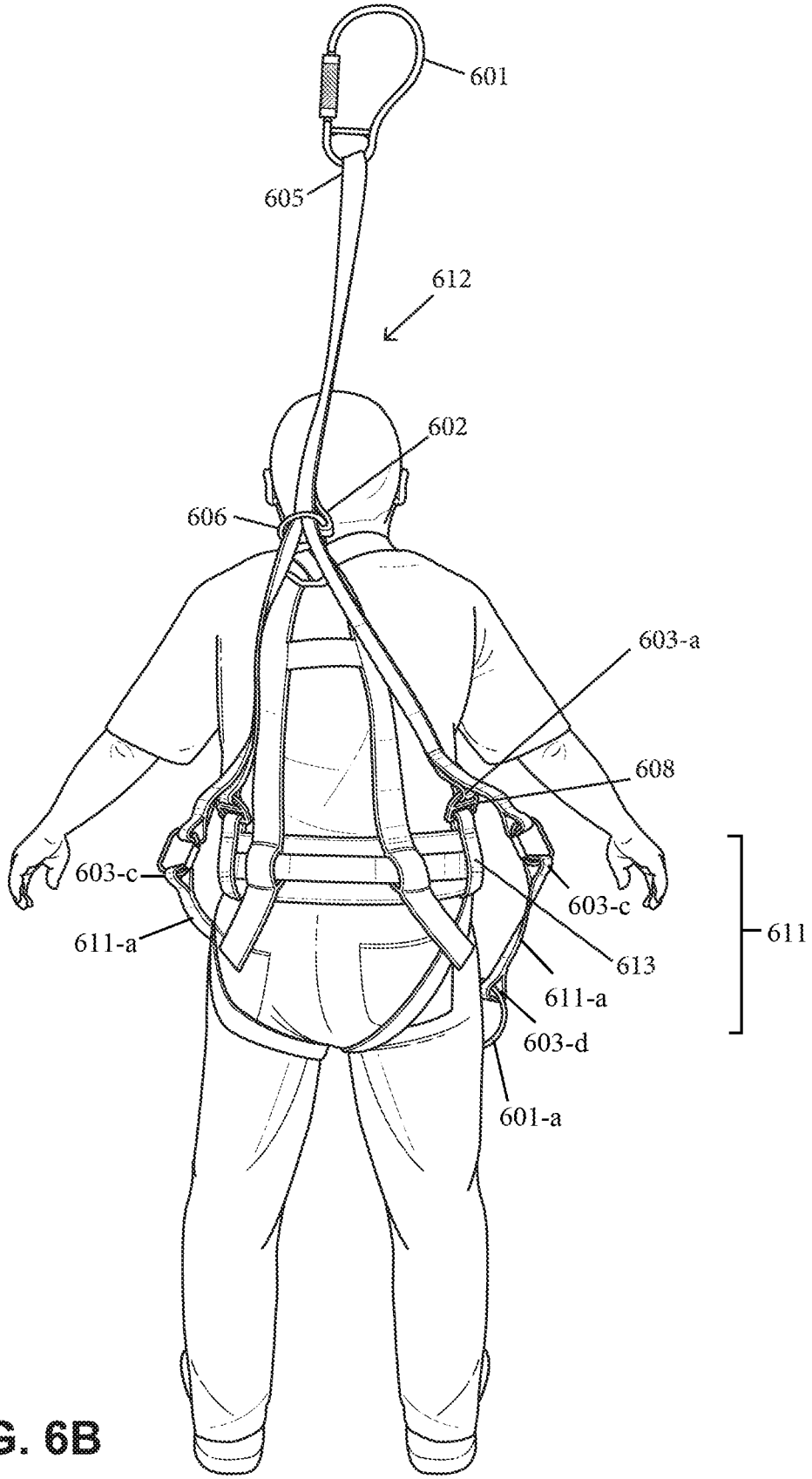
FIG. 6B illustrates the back view of the integral harness system worn by a user, according to an aspect.

FIG. 6B illustrates the back view of the integral harness system 612 worn by a user, according to an aspect. As shown as an example, the integral harness system 612 may allow for the attachment of a second user, or a second weight or load, to be carried below the first user (shown in FIG. 6B). The second user or weight may be attached to the harness adapter connector 611 may be used, which, as described when referring to FIG. 1, may comprise two straps 611-*a* each having a top connector end loop 603-*c* and a bottom connector end loop 603-*d*. An O-ring, 0and/or a second carabiner, or any other suitable locking or ring element 601-*a* may next be attached.

Again, the straps 607 of the integral harness system 612 may both thread through a back ring 606. The back ring 606 may be located at the back of a user's torso, as shown. When a integral harness system 612 is connected to an object or person above the user, by a carabiner 601 or any other suitable locking element threading through top loop 605, the user may be held vertically without any straps or connections in front of them. A connection to a helicopter or to another user by an attachment point on, for example, the user's chest may obstruct the user's vision and/or accessibility to their work. Thus, an advantage of the integral harness system 612 having an attachment point on the user's back is that the user is free of obstructions. Again as was previously described, a the back loop 602 may be directly sewn in with the back ring 606, without the need for a locking element (as shown in FIG. 6A). The bottom loop 603-*a* may be directly sewn in with a belt strap 614 via a locking element 608, without the need for connecting to a belt ring (not shown in this view).

Figure 7A:
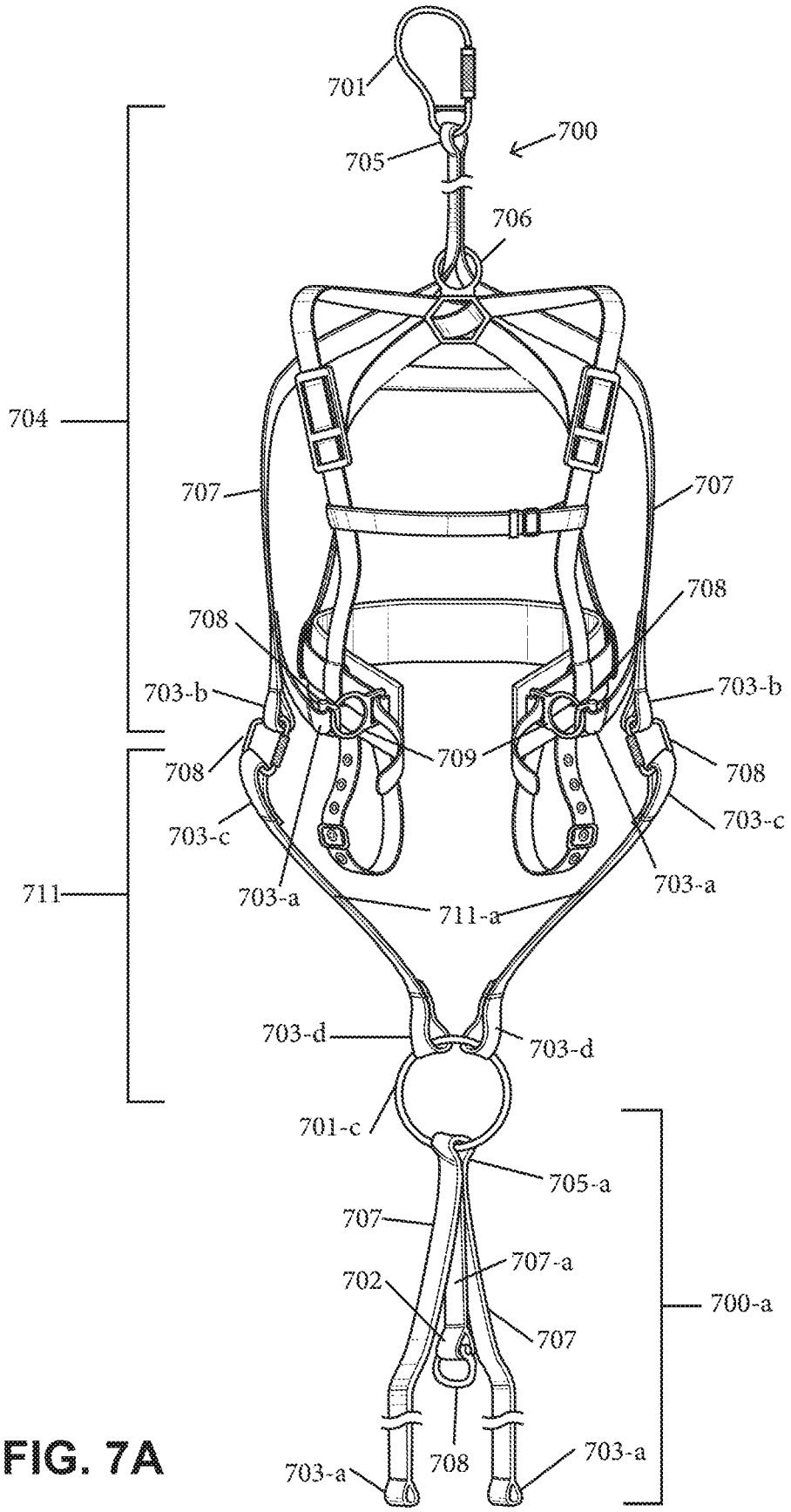
FIG. 7A illustrates a front view of a harness adapter system having a first harness adapter, a first full body harness, and a second harness adapter, and a harness adapter connector, according to an aspect.

FIG. 7A illustrates a front view of a harness adapter system having a first harness adapter 700, a first full body harness 704, and a second harness adapter 700-*a*, and a harness adapter connector 711, according to an aspect. The first harness adapter 700 may be connected with a first full body harness 704 to be worn by a first user (as shown in FIG. 5A). The first full body harness 704 may also be connected to a second harness adapter 700-*a* via a harness adapter connector 711. Again as described when referring to FIG. 1, the harness adapter connector 711 may be provided with straps 711-*a* each having a top connector end loop 703-*c* and a bottom connector end loop 703-*d*. The bottom connector end loops 703-*d* may be connected to an O-ring 701-*c* or any other suitable locking or securing element, for example. It should be understood that, in order to add on a second user or second weight via the second harness adapter 700-*a*, the second harness adapter 700-*a* may be directly hooked onto the O-ring 701-*c*, or, as another example, the top loop 705-*a* of the second harness adapter 700-*a* may be joined with a carabiner that hooks into the O-ring 701-*c*, as shown by the example in FIG. 1.

The straps 707 may pass through the back ring 706. The second harness adapter 700-*a* may include one bottom loop 703-*a* at the end of each strap 707 and 707-*a* as shown, or, if a third user is to be connected, may include two bottom loops, similar to the loops 703-*a* and 703-*b* of the end loop pairs at the ends of the straps 707 of the first harness adapter 700. The bottom loops 703-*a* may connect to the belt rings 709 via a locking element 708. As an example, a plurality of harness adapters may be connected in a line, with a harness adapter connector in between the harness adapters. A second harness adapter 700-*a* may preferably be connected to the harness adapter connector 711 by securing a carabiner, similar to 701, to an O-ring 701-*c* that is threaded into the bottom connector end loops 703-*d*. As another example, the O-ring 701-*c* or any other suitable locking or connecting element may be used to secure the bottom connector end loops 703-*d* of the harness adapter connector 711 to a top loop 705-*a* of a second harness adapter 700-*a*, as shown. The second harness adapter 700-*a* may then be used in association with a second harness worn by a second user. The second harness adapter 700-*a* may also include a back loop 702 having a D-ring 708, or any other suitable locking element, which may be used to lock the harness adapter 700-*a* into a full body harness. The uppermost harness adapter 700 in a chain may be secured to any secure element such as, for example, a helicopter, using the top loop 705 receiving a carabiner 701 or any other locking element, which may then be locked into the secure element.

Figure 7B:
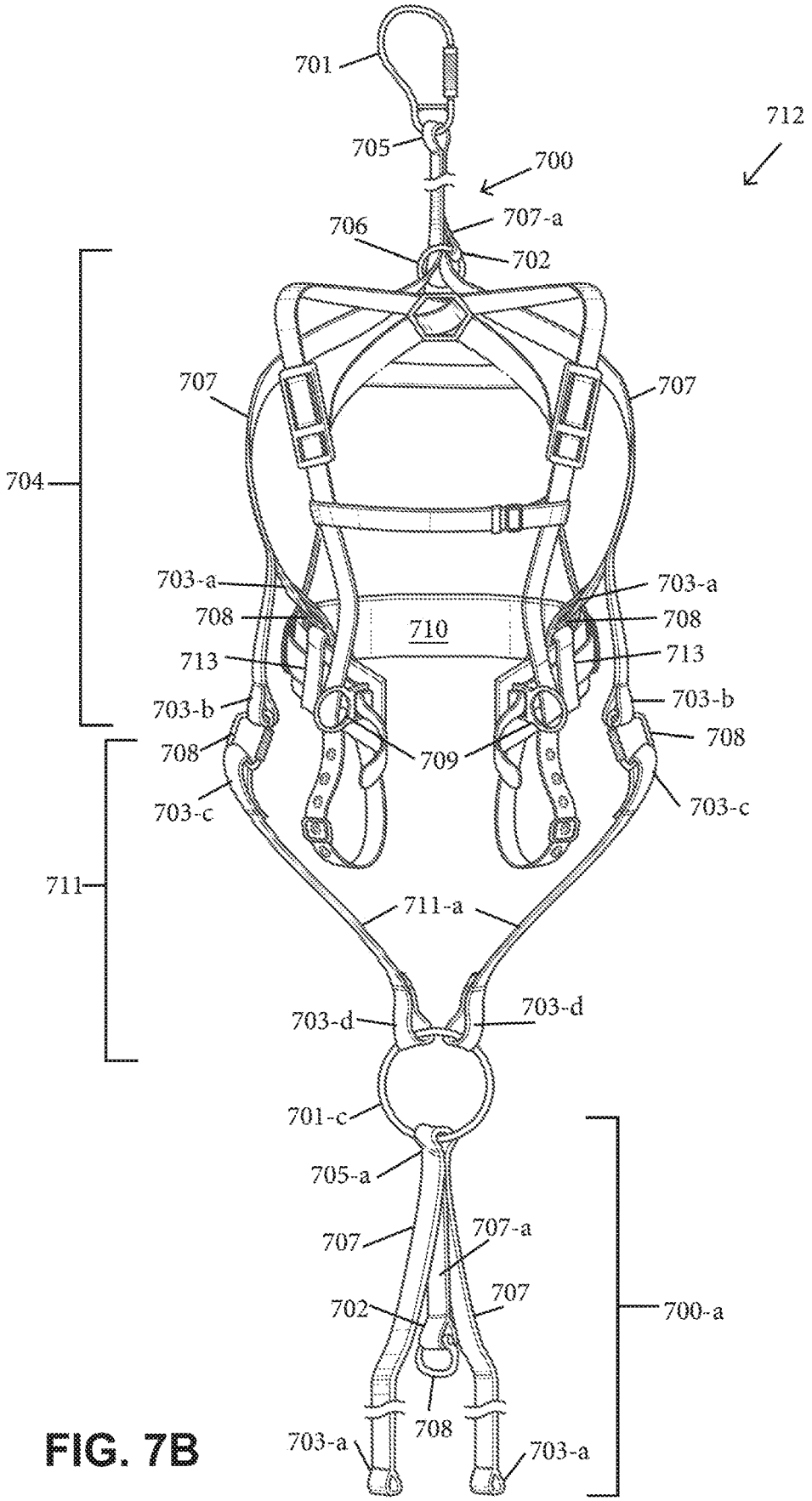
FIG. 7B illustrates a front view of an integral harness system having a first full body harness, and a harness adapter connector that can connect to a second full body harness or attach to any suitable weight or load, according to an aspect.

FIG. 7B illustrates a front view of an integral harness system 712 having a first full body harness 704, and a harness adapter connector 711 that can connect to a second full body harness or attach to any suitable weight or load, according to an aspect. The first full body harness 704 may be worn by a first user (as shown in FIG. 5B), and may be integrally associated with a first harness adapter 700. The first full body harness 704 may also be connected to a second harness adapter 700-*a* via a harness adapter connector 711. Again as discussed when referring to FIG. 7A, it should be understood that, in order to add on a second user or second weight via the second harness adapter 700-*a*, the second harness adapter 700-*a* may be directly hooked onto the O-ring 701-*c*, or, as another example, the top loop 705-*a* of the second harness adapter 700-*a* may be joined with a carabiner that hooks into the O-ring 701-*c*, as shown by the example in FIG. 1.

Again as was previously described when referring to FIGS. 1 and 7A, the harness adapter connector 711 may be provided with straps 711-*a* each having a top connector end loop 703-*c* and a bottom connector end loop 703-*d*. The straps 707 may pass through the back ring 706, and the strap 707-*a* may have a back loop 702 which may have the back ring 706 sewn into it. The bottom connector end loops 703-*d* may be connected to an O-ring 701-*c* or any other suitable locking or securing element, for example. The second harness adapter 700-*a* may include one bottom loop 703-*a* at the end of each strap 707-*a* as shown, or, if a third user is to be connected, may include two bottom loops, similar to the loops 703-*a* and 703-*b* of the end loop pairs at the ends of the straps 707 of the first harness adapter 700. Each bottom loop 703-*a* may have a sewn in locking element 708, which may be connected and sewn in with a belt strap 713 provided on the left and right sides of the belt 710, and each bottom loop 703-*b* may be provided with a sewn in or removable locking element 708, for example.

As an example, a plurality of harness adapters may be connected in a line, with a harness adapter connector in between the harness adapters. A second harness adapter 700-*a* may preferably be connected to the harness adapter connector 711 by securing a carabiner, similar to 701, to an O-ring 701-*c* that is threaded into the bottom connector end loops 703-*d*. As another example, the O-ring 701-*c* or any other suitable locking or connecting element may be used to secure the bottom connector end loops 703-*d* of the harness adapter connector 711 to a top loop 705-*a* of a second harness adapter 700-*a*, as shown. The second harness adapter 700-*a* may then be used in association with a second harness worn by a second user. The second harness adapter 700-*a* may also include a back loop 702 having a D-ring 708, or any other suitable locking element, which may be used to lock the harness adapter 700-*a* into a full body harness. The uppermost harness adapter 700 in a chain may be secured to any secure element such as, for example, a helicopter, using the top loop 705 receiving a carabiner 701 or any other locking element, which may then be locked into the secure element. It should be understood that the second harness and any other additional harnesses used together with the integral harness system 712 may also be provided with integral connections as described when referring to FIGS. 2B, 3B, and 4B. It should also be understood that for the increased ease of use of the system 712, the additional pieces used for carrying additional users or loads may be removable or may also be locked and sewn into the system 712.

It may be advantageous to set forth definitions of certain words and phrases used in this patent document. The term "couple" and its derivatives refer to any direct or indirect communication between two or more elements, whether or not those elements are in physical contact with one another. The term "or" is inclusive, meaning and/or. The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

Further, as used in this application, "plurality" means two or more. A "set" of items may include one or more of such items. Whether in the written description or the claims, the terms "comprising," "including," "carrying," "having," "containing," "involving," and the like are to be understood to be open-ended, i.e., to mean including but not limited to. Only the transitional phrases "consisting of" and "consisting essentially of," respectively, are closed or semi-closed transitional phrases with respect to claims.

If present, use of ordinal terms such as "first," "second," "third," etc., in the claims to modify a claim element does not by itself connote any priority, precedence or order of one claim element over another or the temporal order in which acts of a method are performed. These terms are used merely as labels to distinguish one claim element having a certain name from another element having a same name (but for use of the ordinal term) to distinguish the claim elements. As used in this application, "and/or" means that the listed items are alternatives, but the alternatives also include any combination of the listed items.

Additional definitions for specific terms to this application? If yes, define here . . . .

Throughout this description, the aspects, embodiments or examples shown should be considered as exemplars, rather than limitations on the apparatus or procedures disclosed or claimed. Although some of the examples may involve specific combinations of method acts or system elements, it should be understood that those acts and those elements may be combined in other ways to accomplish the same objectives.

Acts, elements and features discussed only in connection with one aspect, embodiment or example are not intended to be excluded from a similar role(s) in other aspects, embodiments or examples.

Aspects, embodiments or examples of the invention may be described as processes, which are usually depicted using a flowchart, a flow diagram, a structure diagram, or a block diagram. Although a flowchart may depict the operations as a sequential process, many of the operations can be performed in parallel or concurrently. In addition, the order of the operations may be re-arranged. With regard to flowcharts, it should be understood that additional and fewer steps may be taken, and the steps as shown may be combined or further refined to achieve the described methods.

If means-plus-function limitations are recited in the claims, the means are not intended to be limited to the means disclosed in this application for performing the recited function, but are intended to cover in scope any equivalent means, known now or later developed, for performing the recited function.

If any presented, the claims directed to a method and/or process should not be limited to the performance of their steps in the order written, and one skilled in the art can readily appreciate that the sequences may be varied and still remain within the spirit and scope of the present invention.

Although aspects, embodiments and/or examples have been illustrated and described herein, someone of ordinary skills in the art will easily detect alternate of the same and/or equivalent variations, which may be capable of achieving the same results, and which may be substituted for the aspects, embodiments and/or examples illustrated and described herein, without departing from the scope of the invention. Therefore, the scope of this application is intended to cover such alternate aspects, embodiments and/or examples. Hence, the scope of the invention is defined by the accompanying claims and their equivalents. Further, each and every claim is incorporated as further disclosure into the specification.

What is claimed is:

1. An integral lineman safety harness system, comprising:
a first harness adapter; and
a first body harness having:
a belt;
a back ring on a rear side of the first body harness;
a left belt strap sewn onto a left side of the belt; and
a right belt strap sewn onto a right side of the belt;
the first harness adapter having:
a first strap having a first top end, a first bottom end, a first harness loop at the first bottom end, and a first ring element; wherein the first harness loop and the left belt strap are sewn around the first ring element;
a second strap having a second top end, a second bottom end, a second harness loop at the second bottom end, and a second ring element; wherein the second harness loop and the right belt strap are sewn around the second ring element;
a third strap having a third top end, a third bottom end, and a back loop at the third bottom end; wherein the back loop is sewn around the back ring;
wherein the first strap, the second strap, and the third strap join at the first top end, the second top end, and the third top end into a single first top loop configured to receive a first locking element;
wherein the first strap extends through the back ring such that the first harness loop is connected to the left belt strap by the first ring element; and
wherein the second strap extends through the back ring such that the second harness loop is connected to the right belt strap by the second ring element.

2. The integral lineman safety harness system of claim 1, the first strap further comprising a first extension loop at the first bottom end, and the second strap further comprising a second extension loop at the second bottom end.

3. The integral lineman safety harness system of claim 2, further comprising a harness adapter connector having:
a first connector strap having: a first top connector end, a first bottom connector end, a first top connector loop at the first top connector end, and a first bottom connector loop at the first bottom connector end; and
a second connector strap having: a second top connector end, a second bottom connector end, a second top connector loop at the second top connector end, and a second bottom connector loop at the second bottom connector end;
wherein the first extension loop is joined to the first top connector loop by a second locking element; and
wherein the second extension loop is joined to the second top connector loop by a third locking element.

4. The integral lineman safety harness system of claim 2, further comprising a harness adapter connector having:
a first connector strap having: a first top connector end, a first bottom connector end, a first top connector loop at the first top connector end, and a first bottom connector loop at the first bottom connector end; and
a second connector strap having: a second top connector end, a second bottom connector end, a second top connector loop at the second top connector end, and a second bottom connector loop at the second bottom connector end;
wherein the first extension loop is sewn around a third ring element, and the first top connector loop is sewn around the third ring element; and
wherein the second extension loop is sewn around a fourth ring element, and the second top connector loop is sewn around the fourth ring element.

5. The integral lineman safety harness system of claim 1, wherein the first locking element is a carabiner.

6. The integral lineman safety harness system of claim 3, wherein the first locking element and the second locking element are a first D-ring and a second D-ring.

7. The integral lineman safety harness system of claim 1, wherein the first strap and the second strap each have a first length, and the third strap has a second length shorter than the first length.

8. An integral lineman safety harness system, comprising:
a first harness adapter; and
a first body harness having:
a belt;
a back ring on a rear side of the first body harness;
a left belt strap sewn onto a left side of the belt; and
a right belt strap sewn onto a right side of the belt;
a harness adapter connector;
the first harness adapter having:
a first strap having a first top end, a first bottom end, a first harness loop at the first bottom end, a first ring element, and a first extension loop at the first bottom end;
wherein the first harness loop and the left belt strap are sewn around the first ring element;
a second strap having a second top end, a second bottom end, a second harness loop at the second bottom end, a second ring element, and a second extension loop at the second bottom end; wherein the second harness loop and the right belt strap are sewn around the second ring element; and
a third strap having a third top end, a third bottom end, and a back loop at the third bottom end; wherein the back loop is sewn around the back ring;
wherein the first strap, the second strap, and the third strap join at the first top end, the second top end, and the third top end into a single first top loop configured to receive a first locking element;
the harness adapter connector comprising:
a first connector strap having: a first top connector end, a first bottom connector end, a first top connector loop at the first top connector end, and a first bottom connector loop at the first bottom connector end; and
a second connector strap having: a second top connector end, a second bottom connector end, a second top connector loop at the second top connector end, and a second bottom connector loop at the second bottom connector end;
wherein the first strap and the second strap each have a first length, and the third strap has a second length shorter than the first length;
wherein the first strap extends through the back ring such that the first harness loop is connected to the left belt strap by the first ring element;
wherein the second strap extends through the back ring such that the second harness loop is connected to the right belt strap by the second ring element;
wherein the first extension loop is joined to the first top connector loop by a second locking element; and
wherein the second extension loop is joined to the second top connector loop by a third locking element.

9. The integral lineman safety harness system of claim 8, wherein the first bottom connector loop and the second bottom connector loop are configured to receive a fourth locking element.

10. The integral lineman safety harness system of claim 9, further comprising a second harness adapter, having a second top loop configured to receive the fourth locking element.

11. The integral lineman safety harness system of claim 8, wherein the first locking element is a carabiner.

12. The integral lineman safety harness system of claim 8, wherein the first locking element and the second locking element are a first D-ring and a second D-ring.

* * * * *